US006004411A

United States Patent [19]

Zeuner et al.

[11] Patent Number: 6,004,411

[45] Date of Patent: Dec. 21, 1999

[54] AZIDE-FREE GAS-PRODUCING COMPOSITION

[75] Inventors: Siegfried Zeuner, München; Achim Hofmann, Polling; Roland Schropp, Tegernheim; Karl-Heinz Rödig, Kraiburg, all of Germany

[73] Assignee: TRW Airbag Systems GmbH & Co. KG, Aschau/Inn, Germany

[21] Appl. No.: 09/221,449

[22] Filed: Dec. 28, 1998

[30] Foreign Application Priority Data

Dec. 29, 1997 [DE] Germany ..... 297 22 912 U

[51] Int. Cl.[6] ..... C06B 29/16; C06B 25/34

[52] U.S. Cl. ..... 149/78; 149/92

[58] Field of Search ..... 149/78, 92; 102/289, 102/288

[56] References Cited

U.S. PATENT DOCUMENTS 4,366,010 12/1982 Sedat ..... 149/19.6
5,386,775 2/1995 Poole et al. ..... 102/289
5,467,715 11/1995 Taylor et al. ..... 102/89
5,482,579 1/1996 Ochi et al. ..... 149/83
5,756,929 5/1998 Lundstrom et al. ..... 149/22
5,773,754 6/1998 Yamato ..... 149/36
5,861,571 1/1999 Scheffee et al. ..... 102/288

*Primary Examiner*—Charles T. Jordan
*Assistant Examiner*—Aileen J. Baker
*Attorney, Agent, or Firm*—Tarolli, Sundheim, Covell, Tummino & Szabo L.L.P.

[57] ABSTRACT

The present invention relates to an azide-free gas-producing composition, in particular for use in safety devices for motor vehicles, comprising or consisting essentially of a fuel consisting of from 20 to 50% by weight of guanidine nitrate and from 0 to 20% by weight of cyanuric acid, isocyanuric acid, cyamelide and/or melamine;

from 45 to 80% by weight of an oxidant, wherein the oxidant is selected from the group consisting of copper oxide (CuO) and CUO together with potassium perchlorate and/or potassium chlorate, and from 0 to 5% by weight of processing aids.

6 Claims, No Drawings

AZIDE-FREE GAS-PRODUCING COMPOSITION

BACKGROUND OF THE INVENTION

Gas generators used in safety devices for motor vehicles usually contain a propellant based on sodium azide. Sodium azide is toxic, however, as a result of which there have been numerous attempts to develop azide-free propellants.

The German Offenlegungsschrift DE 195 05 568 A1 discloses azide-free propellants of this type which contain at least one compound from the group of tetrazoles, triazoles, triazines, cyanic acid, urea, derivatives or salts thereof as fuel, compounds from the group of peroxides, nitrates, chlorates or perchlorates as oxidation agents, and in addition burn-off moderators which are suitable for influencing the burn-off and the rate thereof by heterogeneous or homogeneous catalysis, as well as optionally additional charges which are suitable for reducing the proportion of toxic gases which are produced during the combustion of the propellant. Propellants are preferred which contain biuret, guanidine, nitroguanidine, guanidine nitrate, aminoguanidine, aminoguanidine nitrate, thiourea, triaminoguanidine nitrate, aminoguanidine hydrogencarbonate, azodicarboxylic acid diamide, dicyandiainide dinitrate, dicyandiamidine sulphate, tetrazene and/or semicarbazide nitrate as well as urethanes, ureides and derivatives thereof as fuel, at least two compounds from the group of peroxides, nitrates, chlorates or perchlorates as oxidation agents, as well as zinc oxide or carbonates of zinc or calcium as burn-off moderators.

A disadvantage of the propellants described in DE 195 05 568 A1 is the use of nitrates as oxidation agents, since under unfavourable circumstances relatively large quantities of nitrous gases $NO_X$ can be formed during the thermal decomposition of these nitrates. For this reason it is necessary to use aggregates in order to reduce the proportion of $NO_X$ in the gas mixture produced. A further disadvantage of the propellant mixtures described lies in the high burn-off temperatures and explosion heat caused by these mixtures. Tests with various mixtures of propellants have shown, however, that high burn-off temperatures always result in high concentrations of harmful gases in the gas mixture produced.

U.S. Pat. No. 5,467,715 discloses a gas-producing composition with between substantially 20 and 40% by weight of a fuel, between substantially 20 and 80% by weight of an oxidant, and the remainder customary additives. From 50 to substantially 85% by weight of the propellant consists of a triazole or tetrazole, between substantially 15 and substantially 50% by weight of the propellant consists of a water-soluble fuel, such as for example guanidine nitrate, ethylenediamide dinitrate or similar compounds. At least substantially 20% by weight of the oxidant contains a transition-metal oxide, and the remainder of the oxidant is formed from alkali or alkaline-earth metal nitrates, chlorates or perchlorates. The use of transition-metal oxides as the main constituent of the oxidant is intended to lead to a lowering in the combustion temperatures and to a reduction in the proportion of toxic gases. The production of the compositions described is carried out in a wet-chemical manner by mixing together the constituents of the propellant mixture in an aqueous slurry.

The 5-aminotetrazole preferably used as a fuel in accordance with U.S. Pat. No. 5,467,715 is extremely hygroscopic, however, and thus makes exacting demands upon environmental conditions both during storage and in the processing of the propellant mixtures. Because of the high degree of hygroscopicity of these propellant mixtures, it is additionally necessary to ensure the sealing tightness of the gas generator containing this propellant over the entire duration of its use, since absorption of water has a very powerful effect upon the burn-off characteristics of the fuel. Water in the form of water of crystallization is bonded by 5-aminotetrazole and is released by it again only under extreme conditions.

A further disadvantage is the treatment of the described propellant mixture in a wet process. This wet process requires additional costly steps of moistening and drying, which preclude an economical production of the propellant. In addition, it has been found in tests that 5-aminotetrazole and copper oxide (CuO) are incompatible with each other. Ballistic tests after long-term temperature storage at 110° C. over 400 hours have revealed greatly increased combustion-chamber pressures in the case of a propellant mixture of this type. There is therefore no guarantee of the long-term stability of these propellant mixtures.

SUMMARY OF THE INVENTION

In view of the above, it is an object of the invention to provide azide-free gas-producing compositions for use in safety devices for motor vehicles, by which the disadvantages mentioned above can be avoided and which have balanced properties with respect to the combustion temperatures, the proportions of toxic gases in the gas mixture produced, the formation of combustion residues which can be properly filtered and the long-term stability with respect to thermal and chemical environmental influences.

The azide-free gas-producing composition according to the. invention comprises or consists essentially of a fuel consisting of from 20 to 50% by weight of guanidine nitrate and from 0 to 20% by weight of cyanuric acid, isocyanuric acid, cyamelide and/or melainine, from 45 to 80% by weight of an oxidant, the oxidant being selected from the group which comprises copper oxide (CuO) and CuO together with potassium perchlorate and/or potassium chlorate, and from 0 to 5% by weight of processing aids.

Advantageous embodiments of the invention are set out in the subclaims.

A composition preferred according to the invention consists of a mixture of guanidine nitrate as a fuel, CuO as an oxidant as well as customary processing aids, such as for example pressing aids, flowing aids and/or sliding agents. Examples of processing aids of this type are polyethylene glycol, cellulose, methylcellulose, graphite, wax, magnesium stearate, zinc stearate, boron nitride, talcum, bentonite, silicon dioxide or molybdenum sulphide.

It has surprisingly been found that the pressability of the mixtures consisting of guanidine nitrate and CuO can be further improved by using up to 20% by weight of cyanuric acid, isocyanuric acid, cyamelide and/or melamine as an additional fuel. In addition, it is preferable to add substantially from 5 to 20% by weight of potassium perchlorate and/or potassium chlorate, by which the ignitability and the burn-off rate of the propellant composition can be improved. The burn-off rate can additionally be perceptibly increased by using finely ground guanidine nitrate of at most 5 $\mu$m and/or finely ground CuO with an average grain size of at most 3 $\mu$m.

As a result of the low burn-off temperatures and dispensing with metal nitrates as oxidation agents, gas-producing compositions are made accessible according to the invention which produce very low concentrations of harmful gases and which are suitable for use in airbag gas generators.

The compositions according to the invention have a low degree of hygroscopicity as compared with the propellant mixtures known from the prior art. Only with a relative air moisture of >65% do these compositions absorb more than 0.5% by weight of water. In the case of propellants containing 5-aminotetrazole, on the other hand, water absorption of >1% by weight can be established after a short time even with an air moisture of 45%. In addition, in tests into long-term temperature storage at 110° C. over 400 hours the compositions according to the invention displayed no change in their ballistic properties.

The combustion temperatures of the gas-producing compositions according to the invention are below 1750 K. These low combustion temperatures lead directly to a low proportion of toxic gases in the gas mixture produced.

As a result of the optimum setting of the oxygen balance of the propellant mixture this proportion of toxic gases can be additionally reduced. With a composition which is over-balanced with respect to oxygen the $NO_X$ proportion increases, whereas with a composition which is under-balanced with respect to oxygen an increased formation of carbon monoxide (CO) can be observed. In this case the formation of $NO_X$ as a result of an over-balancing of oxygen takes place over-proportionally to the reduction in the CO content in the gas mixture. Since, however, an increase in the $NO_X$ concentration in the gas mixture can be reduced by a low combustion temperature, it is possible by means of a simultaneous over-balancing of the composition with respect to oxygen to reduce both the CO concentration (above the oxygen balance) and the $NO_X$ concentration (above the combustion temperature).

By using CuO as the main constituent of the oxidant in the compositions according to the invention, when they are burned copper-containing slags are additionally produced which can be satisfactorily filtered. This leads to a reduced content of fine dust in the gas mixture produced. In addition, it is possible to process the compositions according to the invention in the dry process without difficulty.

DESCRIPTION OF PREFERRED EMBODIMENTS

The following examples describe particularly preferred embodiments of the invention.

EXAMPLE 1

21% by weight of micronized guanidine nitrate with an average grain size of 3 μm, 11.1% by weight of ground cyanuric acid with an average grain size of 12 μm, 54% by weight of finely ground copper oxide with an average grain size of 1 μm and 13.9% by weight of ground potassium perchlorate with an average grain size of 10 μm are mixed together dry and are then pressed to form propellant tablets. The tablets produced in this way were introduced into a gas generator for ignition. The adiabatic combustion temperature of this composition was 1584 K. The CO proportion—determined in the closed tank performance test with a combustion of about 150 g of propellant—in the gas mixture produced amounted to 300 ppm, and the $NO_X$ proportion amounted to 40 ppm.

EXAMPLE 2

28.2% by weight of micronized guanidine nitrate with an average grain size of 3 μm, 10.1% by weight of ground cyanuric acid with an average grain size of 12 μm, 49.1% by weight of finely ground copper oxide with an average grain size of 1 μm and 12.6% by weight of ground potassium perchlorate with an average grain size of 10 μm were homogenized dry and were then pressed to form propellant tablets. The adiabatic combustion temperature of this composition was 1708 K. The CO proportion—determined in the closed tank performance test with a combustion of about 150 g of propellant—in the gas mixture produced amounted to 350 ppm, and the $NO_X$ proportion amounted to 20 ppm.

We claim:

1. An azide-free gas-producing composition, in particular for use in safety devices for motor vehicles, comprising a fuel consisting of from 20 to 50% by weight of guanidine nitrate and from 0 to 20% by weight of cyanuric acid, isocyanuric acid, cyamelide and/or melamine;

from 45 to 80% by weight of an oxidant, wherein the oxidant is selected from the group consisting of copper oxide (CuO) and CuO together with potassium perchlorate and/or potassium chlorate, and from 0 to 5% by weight of processing aids.

2. The composition according to claim 1, consisting of from 20 to 50% by weight of guanidine nitrate and from 0 to 20% by weight of cyanuric acid, isocyanuric acid, cyamelide and/or melamine as a fuel;

from 40 to 60% by weight of CuO and from 5 to 20% by weight of potassium perchlorate and/or potassium chlorate as an oxidant, and from 0 to 5% by weight of processing aids.

3. The composition according to claim 1, consisting of from 20 to 30% by weight of guanidine nitrate and from 10 to 15% by weight of cyanuric acid, isocyanuric acid, cyamelide and/or melamine as a fuel;

from 45 to 55% by weight of CuO and from 10 to 15% by weight of potassium perchlorate and/or potassium chlorate as an oxidant, and from 0 to 5% by weight of processing aids.

4. The composition according to claim 1, wherein the guanidine nitrate has an average grain size of at most 5 μm.

5. The composition according to claim 1, wherein the CuO has an average grain size of at most 3 μm.

6. The composition according to claim 1, wherein the composition is over-balanced with respect to oxygen.

* * * * *